US006742451B1

(12) United States Patent
Junghans

(10) Patent No.: US 6,742,451 B1
(45) Date of Patent: Jun. 1, 2004

(54) METHOD OF CONTROLLING A SUPPLY OF INK IN A PRINTING MACHINE, AND A PRINTING MACHINE FOR PERFORMING THE METHOD

(75) Inventor: Rudi Junghans, Wilhelmsfeld (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 100 days.

(21) Appl. No.: 09/598,580

(22) Filed: Jun. 21, 2000

(30) Foreign Application Priority Data

Jun. 21, 1999 (DE) ..... 199 28 250

(51) Int. Cl.[7] ..... B41F 31/02
(52) U.S. Cl. ..... 101/365; 101/484
(58) Field of Search ..... 101/350.3, 350.6, 101/365, 484, 485

(56) References Cited

U.S. PATENT DOCUMENTS

| | | | |
|---|---|---|---|
| 3,983,812 | A | 10/1976 | Schramm |
| 4,787,313 | A | 11/1988 | Osborn et al. |
| 5,029,526 | A | 7/1991 | Kipphan et al. |
| 5,170,711 | A | 12/1992 | Maier et al. |
| 5,701,817 | A | 12/1997 | Thünker et al. |

FOREIGN PATENT DOCUMENTS

| | | |
|---|---|---|
| DE | 23 36 061 A1 | 2/1975 |
| DE | 24 43 504 A1 | 4/1976 |
| DE | 36 14 555 C2 | 11/1987 |
| DE | 37 14 160 A1 | 11/1987 |
| DE | 40 04 056 A1 | 8/1991 |
| DE | 43 41 011 A1 | 6/1995 |
| DE | 44 35 991 C2 | 4/1996 |
| DE | 197 11 918 A1 | 9/1998 |
| GB | 1 474 254 | 5/1977 |
| JP | 59-71863 A | 4/1984 |

*Primary Examiner*—Ren Yan
(74) *Attorney, Agent, or Firm*—Laurence A. Greenberg; Werner H. Stemer; Gregory L. Mayback

(57) ABSTRACT

A method of controlling the supply of ink in a printing machine wherein the ink is differently guided zonally on an ink-fountain roller transversely to the printing direction, and is transferred by a vibrator roller to a distributor roller, includes metering the ink zonally for counteracting ink transfer disturbances caused by a stroke movement of the distributor roller, so as to minimize the disturbances automatically to at least an effective extent; and a printing machine for performing the method.

7 Claims, 4 Drawing Sheets

METHOD OF CONTROLLING A SUPPLY OF INK IN A PRINTING MACHINE, AND A PRINTING MACHINE FOR PERFORMING THE METHOD

BACKGROUND OF THE INVENTION

FIELD OF THE INVENTION

The invention relates to a method of controlling a supply of ink in a printing machine, more particularly, wherein the ink is differently guided zonally on an ink-fountain roller transversely to the printing direction, and is transferred by a vibrator roller to a distributor roller, and to a printing machine for performing the method, including an electronic control device, an ink metering device and a distributor roller having a starting time that is adjustable relative to a rotational-angle setting of a printing-form cylinder.

In modern printing machines, the instant of reversal, referred to hereinafter as the application time or starting time, is adjustable relative to the phase angle of the printing-form or plate cylinder, with the distributor roller located in a dead center position beginning to oscillate in a direction towards the dead center position opposite thereto at that instant of time. Consequently, it is possible for the pressman to compensate for the fall-off in ink layer thickness over the format length, a phenomenon known as ink fading, in the printing direction. The causes for the ink fading can be a nonuniform division of subjects on the printing form and the print-free space on the printing form cylinder caused by the cylinder gap. The not as yet compensated-for ink fading can, for example, have a maximum of the ink layer thickness thereof at the printing start, and a minimum of the ink layer thickness thereof at the printing end on the printing form. In this case, by adjusting the starting time, the maximum of the ink layer thickness can be displaced from the printing start in the printing direction as far as the center of the format, so that the ink fading on the printed product is no longer perceptible with the naked eye.

In this regard, the German Published Non-prosecuted Application (DE-OS) 23 36 061 describes a device by which the beginning of the distribution of ink on distributor rollers is adjustable relative to the rotational movement of a plate cylinder.

The published German Patent Document DE 36 14 555 C2 describes a method of setting the starting time of the lateral distribution, by which the optimum starting or application time is determined directly by the computer of a measuring device.

The published German Patent Document DE 40 04 056 A1 describes a device for performing a method for controlling ink and for zonally presetting ink metering elements, wherein an oscillation phase angle of an oscillating distributor is controlled by a ghosting computer in accordance with a subject-specific inking profile that is to be expected from an original.

In all of the devices and methods described in the aforementioned published documents, the oscillatory movement of the distributor roller is controlled.

As is generally known, many printing machines include an ink metering device by which the quantity of ink supplied into the inking unit is zonally adjustable, so that the quantity of ink that is supplied can be metered differently over the format width in accordance with an inking profile suitable for the subject.

In this regard, the published German Patent Document DE 43 41 011 A1 describes a method of controlling ink by which ink is not supplied in specific zones on the ink-fountain roller. Although in this method the lateral ink flow due to the transverse distribution is taken into consideration in adjusting the ink density of individual zones, the method has no relationship whatsoever to the starting or inception time for an operating range of a distributor roller.

A drawback in this method is that, in the course of the conceivable performance thereof by a printing machine with a distributor roller having an adjustable starting time, during the adjustment of the starting time by the pressman, the zonal ink adjustment must be reset manually every time, because the ink fading and the zonal ink adjustment are actuating values which compete with one another. Especially great problems arise therefrom in label printing and in other multiple-copy work, because there is a requirement therein for all the blanks arranged on the sheet of printing material to be printed in absolutely the same hue. For example, the green hue of labels to be printed on the sheet of printing material is produced by autotypical or half-tone ink mixing of the cyan and yellow inks printed after one another. In this regard, the slightest deviations from one another of the ink layer thickness of the yellow ink on two labels are noticeable in a conspicuously disturbing manner when the hues of the two labels are compared.

The foregoing also applies to a printing device described in the Japanese Published Non-prosecuted Patent Application (JP-OS) 59-71 863, and to a method described in the published German Patent Document DE 197 11 918 A1.

In practice, the zonal ink metering device is preset initially in accordance with an inking profile suitable for a subject, for which purpose data determining the inking profile are fed to the ink metering device from a plate scanner. It is then an obligation of the pressman to adjust the starting or inception time and to correct the preset inking profile so that the hue of all the labels located within the format area is the same to the greatest possible extent. These manual adjustments are very time-consuming and laborious. If the pressman adjusts the starting time in order to balance the hue of labels located at the start of printing with the hue of labels located at the end of printing, the hue balance or equalization of labels located beside one another transverse to the printing direction is lost. In order to balance the hue on labels located at the side edges of the format to the hue of labels located at the center of the format, the printer has to correct the zonal metering again, due to which the hue balance in the printing direction is, in turn, influenced detrimentally. Balancing or equalizing the hue is particularly difficult in the case of an even-numbered, for example half-turn, vibrator cycle, in conjunction with an even-numbered, for example likewise half-turn, distributor cycle, because in this case it is additionally necessary to balance the hue of labels located on the right-hand side edge of the format with the hue of labels located on the left-hand side edge. A half-turn cycle means that the printing plate cylinder executes two revolutions for each vibrator or distributor oscillation. The pressman must adjust the starting time and the zonal ink metering in ever finer actuating steps and alternately until the pressman has found the optimum color balance of all the labels over the entire format area.

SUMMARY OF THE INVENTION

With a view to these problems, which have heretofore been unsolved in practice, it is an object of the invention to provide a method of controlling the supply of printing ink in a printing machine, wherein the pressman is relieved of lengthy setting-up operations, and to provide a printing machine for performing the method effectively.

With the foregoing and other objects in view, there is provided, in accordance with one aspect of the invention, a method of controlling the supply of ink in a printing machine wherein the ink is differently guided zonally on an ink-fountain roller transversely to the printing direction, and is transferred by a vibrator roller to a distributor roller, which comprises metering the ink zonally for counteracting ink transfer disturbances caused by a stroke movement of the distributor roller, so as to minimize the disturbances automatically to at least an effective extent.

In accordance with another mode, the ink transfer disturbances are at least one of ink deficiency and ink excess disturbances resulting from a change in a periodically repeating edge offset of the distributor roller with respect to the vibrator roller as ink is transferred from the vibrator roller to the distributor roller, the disturbances being located in the vicinity of the edge offset, and the method includes compensatingly adjusting the supply of ink in at least one of the inking zones affected by the ink transfer disturbances so as to effectively minimize or eliminate the ink transfer disturbances.

In accordance with a further mode, the method of the invention includes adjusting an inflow of ink into at least one inking zone close to a roller edge so as to compensate for the ink transfer disturbances.

In accordance with a second aspect of the invention, there is provided a printing machine including an electronic control device and a distributor roller having a starting time that is adjustable relative to a rotational angle position of a printing form cylinder, comprising an ink metering device zonally adjustable by the electronic control device in accordance with the starting time of the distributor roller.

In accordance with another feature of the invention, one of a distributor stroke drive and a distributor stroke drive transmission of the distributor roller is controllingly connected to the electronic control device, so that the ink metering device is zonally adjustable by the electronic control device in accordance with the one of the distributor stroke drive and the distributor stroke drive transmission, respectively.

In accordance with a further feature of the invention, the distributor stroke drive transmission has a potentiometer assigned thereto that is adjustable together with the adjustment of the distributor stroke drive transmission, and is capable of signalling to the electronic control device the amount of the adjustment of the distributor stroke drive transmission and, therewith, the starting time of the distributor roller.

In accordance with an added feature of the invention, the ink metering device includes at least one ink metering element close to a roller edge, the one ink metering element being adjustable by the electronic control device in accordance with the starting time of the distributor roller.

In accordance with an additional feature of the invention, the ink metering device includes at least one ink metering element that is adjustable both in accordance with a zonal inking profile suitable for a respective subject and in accordance with the starting time of the distributor roller.

In accordance with yet another feature of the invention, the electric control device is capable of acquiring data for determining a zonal inking profile suitable for a respective subject.

In accordance with a concomitant feature of the invention, the ink metering device is automatically adjustable in an actuating direction by the electronic control device in accordance with an adjustment of the starting time of the distributor roller, so as to compensate for inking-related effects of an adjustment of the starting time of the distributor roller relative to a rotational angle position of the printing form cylinder.

Thus, the method according to the invention for controlling the supply of ink in a printing machine, wherein the ink is guided transversely to the printing direction zonally differently on an ink-fountain roller and is transferred by a vibrator roller to a distributor roller, includes automatically compensating for ink transfer disturbances caused by the axial stroke or reciprocating movement of the distributor roller, to the greatest possible extent by adjusting the zonal ink metering. One advantage of the method is that no readjustment work is required to be performed manually, and the pressman can rely on the fact that, after the adjustment of the starting time of the distributor roller, the inking over the entire format width matches precisely as before. The method is, moreover, advantageous with regard to the controlled balancing of inking-profile distortion, the control being performed by an electronic control device. The ink-profile distortion is caused by a change, relative to the phase angle setting of a printing form cylinder, of a position of the distributor roller with respect to the vibrator roller, the position of the distributor roller being offset periodically and repeatedly in the axial direction, and relative to an inking unit roller, as ink is transferred from the vibrator roller via the distributor roller to the inking-unit roller.

In an advantageous refinement of the method, in order to develop the method according to the invention with regard to a rapidly reacting adaptation of the inking profile of an ink metering system to the newly adjusted starting time, the ink deficiency disturbance caused by the distributor stroke or reciprocating movement after the adjustment of the starting time in a specific inking zone or in a number of specific inking zones is compensated for by increasing the supply of ink into this zone or into these zones, and/or the ink excess disturbance caused by the distributor stroke or reciprocating movement in a specific inking zone or in a number of specific inking zones is compensated for by reducing the supply of ink into this zone or into these zones.

In a further refinement of the method, which is advantageous with regard to avoiding under-inked or over-inked circumferential stripes on the circumferential regions of the inking-unit roller which are close to the side edges, the ink transfer disturbances are compensated for by increasing or decreasing the supply of ink into an inking zone close to the side edge of the vibrator roller or into a number of inking zones located beside one another close to the edge of the vibrator roller.

The printing machine according to the invention, including an electronic control device, an ink metering device and a distributor roller with a starting time that can be adjusted in relation to the rotational angle position of a printing form cylinder, is distinguished by the fact that the ink metering device can be readjusted under computer control after an adjustment to the starting time of the distributor roller. With this printing machine, the method of the invention can be performed very effectively, inking disturbances caused by a changed lateral edge offset of the distributor roller being eliminated or adequately and effectively minimized by the zonal supply or withdrawal of ink, which is performed automatically and counteracts these disturbances. The ink metering device can thus be tracked under electronic control to a changed axial phase angle of the distributor roller, relative to the vibrator roller which strikes the latter, by adjusting the starting time of the distributor roller relative to the rotational phase angle of the printing form cylinder. As a result, the ink transfer that is distorted in the axial direction can be compensated for without any manual controlled intervention.

In an embodiment of the invention that is advantageous with regard to driving the distributor stroke or reciprocating movement by an electric motor or a transmission mechanism in order to develop the printing machine according to the invention, a distributor stroke or reciprocating drive or transmission of the distributor roller, and the ink metering device are coupled to one another in terms of control technology via the electronic control device, so that the ink metering device can be adjusted zonally by the electronic control device in accordance with the distributor stroke or reciprocating drive or transmission. The electronic control device includes at least one microprocessor and may include two intercoupled microprocessors, one of which is linked to the ink metering device and the other is linked to the distributor stroke or reciprocating drive or transmission and, for example, to a potentiometer thereof.

In a further embodiment, which is advantageous with regard to very precise detection of the adjustment of the starting time, the distributor stroke or reciprocating drive transmission is positively coupled to a potentiometer, which can be rotated or displaced as a result of a displacement of the distributor stroke or reciprocating drive transmission, and via which the distributor stroke or reciprocating drive transmission is linked in control-technology terms to the electronic control device.

In an embodiment that is advantageous with regard to compensating for too high or too low an optical density in the side region of the printing format, as a result of the adjustment of the starting time of the distributor roller, a metering element for controlling the ink supply in an inking zone close to the side edge of the vibrator roller, or a number of metering elements for controlling the ink supply, respectively located adjacent one another in an inking zone close to the edge of the roller, can be readjusted under computer control following an adjustment to the starting time of the distributor roller.

In a further embodiment, which is advantageous with regard to calculating a corrected rotational or advanced position of the metering element or of the metering elements based upon pairs or groups of values stored in the electronic control device and, for this purpose, determined in advance, for example empirically, a corresponding characteristic curve or functional equation, which describes the relationship between, on the one hand, the adjustment phase angle of the starting time of the distributor roller and, if necessary or desirable, in addition the necessary zonal optical density or the preset zone opening value and, on the other hand, the rotation or displacement of the respective metering element by a correction value required for correcting the inking profile, the zonal ink flow of each metering element to be readjusted results from a zone opening value, that has been corrected in accordance with the adjustment of the starting time, of the already set inking profile suitable for the subject. The correction value can be selected by the electronic control device, starting from the previously set inking profile suitable for the subject and the not yet corrected zone opening value thereof, and calculated from the adjustment phase angle or current starting time or from the stored data sets. The determined correction value may have a sign, for example depending upon the actuating direction required, positive in order to increase and negative in order to decrease the ink flow of the metering element. In the example, the electronic control device adds the correction value, with the sign thereof, to the not yet corrected zone opening value, and adjusts the metering element into a position corresponding to the result of the addition.

In an embodiment that is adapted to the different technical conditions in the pre-press stage, the zone opening values, which have not yet been corrected and which determine the inking profile of the metering elements that is suitable for the subject, can be adjusted manually on the electronic control device and can be read into the electronic control device and stored in the latter by a mobile data carrier (for example by floppy disk or magnetic tape cassette) or by a data line (for example from a plate scanner).

In a further embodiment, which is advantageous with regard to avoiding rejects or waste, the ink metering device can be tracked to the adjustment of the starting time by the electronic control device during this adjustment, so that undesired effects in the printed image, which are caused by the adjustment of the starting time, even become impossible to see.

The printing machine is preferably a sheet-fed rotary offset printing machine with a vibrator-type inking unit.

Other features which are considered as characteristic for the invention are set forth in the appended claims.

Although the invention is illustrated and described herein as embodied in a method of controlling the supply of ink in a printing machine, and a printing machine for performing the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
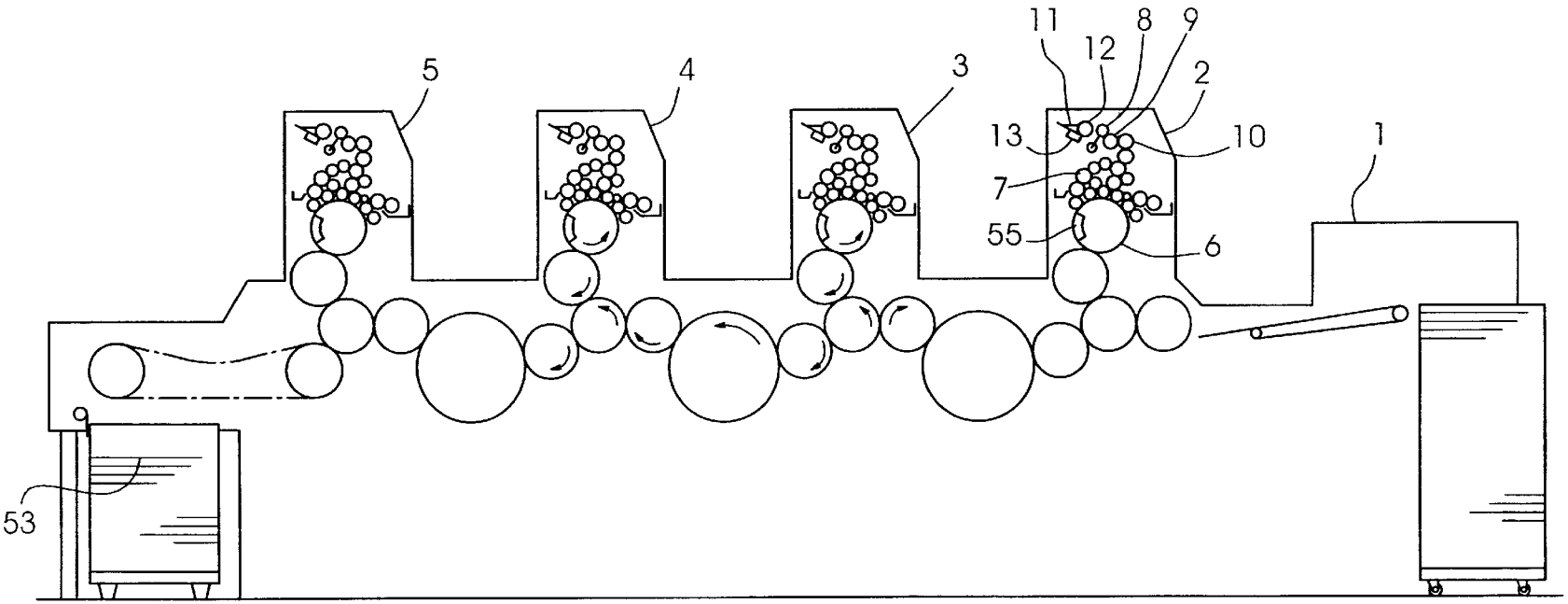
FIG. 1 is a diagrammatic side elevational view of a printing machine with an inking unit.

Referring now to the drawings and, first, particularly to FIG. 1 thereof, there is shown therein a printing machine 1 constructed as a sheet-fed rotary offset printing machine having several, namely four, printing units 2 to 5 in this embodiment, each of which includes a printing form cylinder 6 and an inking unit 7 for inking the latter. The inking unit 7 includes, inter alia, a vibrator roller 8, a distributor roller 9, an inking-unit roller 10 and an ink fountain 11 having an ink-fountain roller 12.

Figure 2:
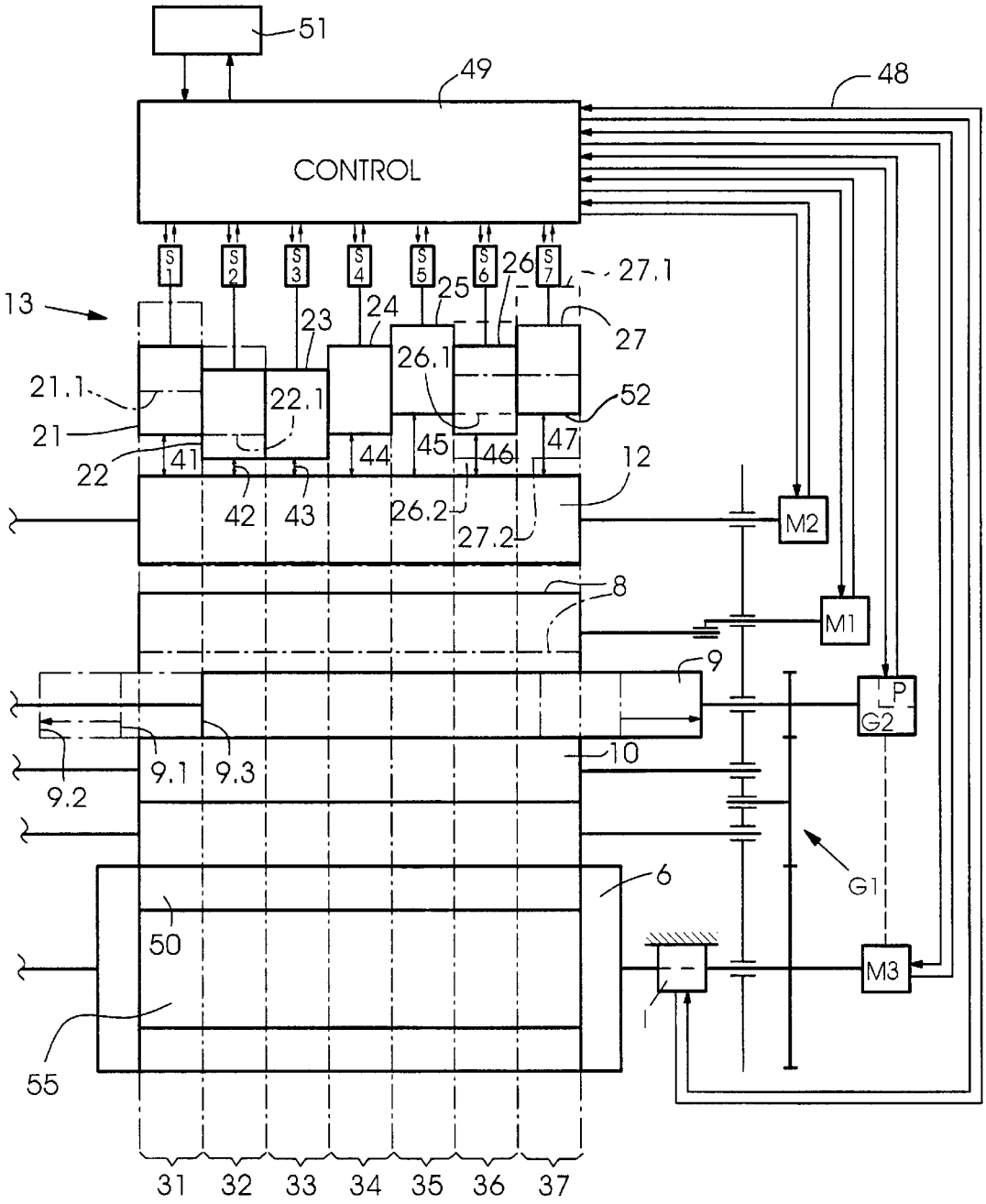
FIG. 2 is an enlarged diagrammatic and schematic plan view of the inking unit of FIG. 1 showing drives and an ink metering device appertaining thereto.

FIG. 2 illustrates an ink metering device 13 arranged on the ink fountain 11 and including a row of individually adjustable metering elements 21 to 27 assigned to the ink-fountain roller 12. Each metering element 21 to 27 determines the ink supply from the ink fountain 11 into a respective inking zone 31 to 37 on the ink-fountain roller 12 and, for this purpose, is adjustable by a respective electric actuating motor S1 to S7. Each metering element 21 to 27, together with the ink-fountain roller 12, if necessary or desirable with a resilient ink-fountain film located therebetween, forms a metering gap 41 to 47, the ink flow of which between the respective metering elements 21 to 27 and the ink-fountain roller 12 is adjustable by the respective electric actuating motor S1 to S7 as a consequence of adjusting the respective metering element 21 to 27. The metering elements 21 to 27 may be rotatable metering eccentrics and, for the purpose of a clearer understanding, are illustrated as metering slides.

The inking zones 31 to 37 are circumferential stripes lying adjacent one another on the ink-fountain roller 12, the stripes 31 to 37 extending transversely to the printing material transport direction and having different ink layer thicknesses, and continuing to extend in the ink transport direction through the inking unit, on the vibrator roller 8, the distributor roller 9 and the inking-unit roller 10, to the printing form cylinder 6.

The reciprocatory movement of the vibrator roller 8 for making mutual alternating contact thereof with the ink-fountain roller 12 and the distributor roller 9 is drivingly effected by the electric motor M1. The ink-fountain roller 12 is rotatingly driven by the electric motor M2, and the printing form cylinder 6 is rotatingly driven by the electric motor M3, which simultaneously rotatingly drives the distributor roller 9 via a mechanism G1 and drivingly produces the axial oscillation of the distributor roller 9 via a transmission mechanism G2. The electric motors M1, M2 and M3 are linked via electric lines 48 to an electronic control device 49 in order to match the rotational speeds thereof with one another. In addition, each actuating motor S1 to S7 is linked to the control device 49 and is drivable by the latter so as to adjust the metering element 21 to 27 thereof, so that the respective metering gap 41 to 47 of the respective metering element 21 to 27 can be adjusted in a manner corresponding to the inking zone-related area coverage of a printing form 50.

The inking zone-related area coverage values can be entered into the control device 49, by reading the area coverage value from the printing form 50 by a plate or form scanner 51 before the printing form 50 is clamped onto the printing form cylinder 6. The entered data and the resulting positions of the metering elements 21 to 27 produce a zonal inking profile 52 suitable for the subject, which is illustrated as a thick line in FIG. 2.

A potentiometer P of a drive transmission G2, and an incremental encoder I signaling the rotational phase angle of the printing form cylinder 6 to the control device 49 are likewise connected to the control device 49. In the event of an adjustment of the drive transmission G2 for changing the axial phase angle of the distributor roller 9 relative to the rotational phase angle of the printing form cylinder 6 or, in other words, in order to set a new starting time of the distributor roller 9, the potentiometer P together with the drive transmission G2 is forcibly adjusted, due to which the control device 49 receives a signal from the potentiometer P regarding the newly set starting time.

Figure 3:
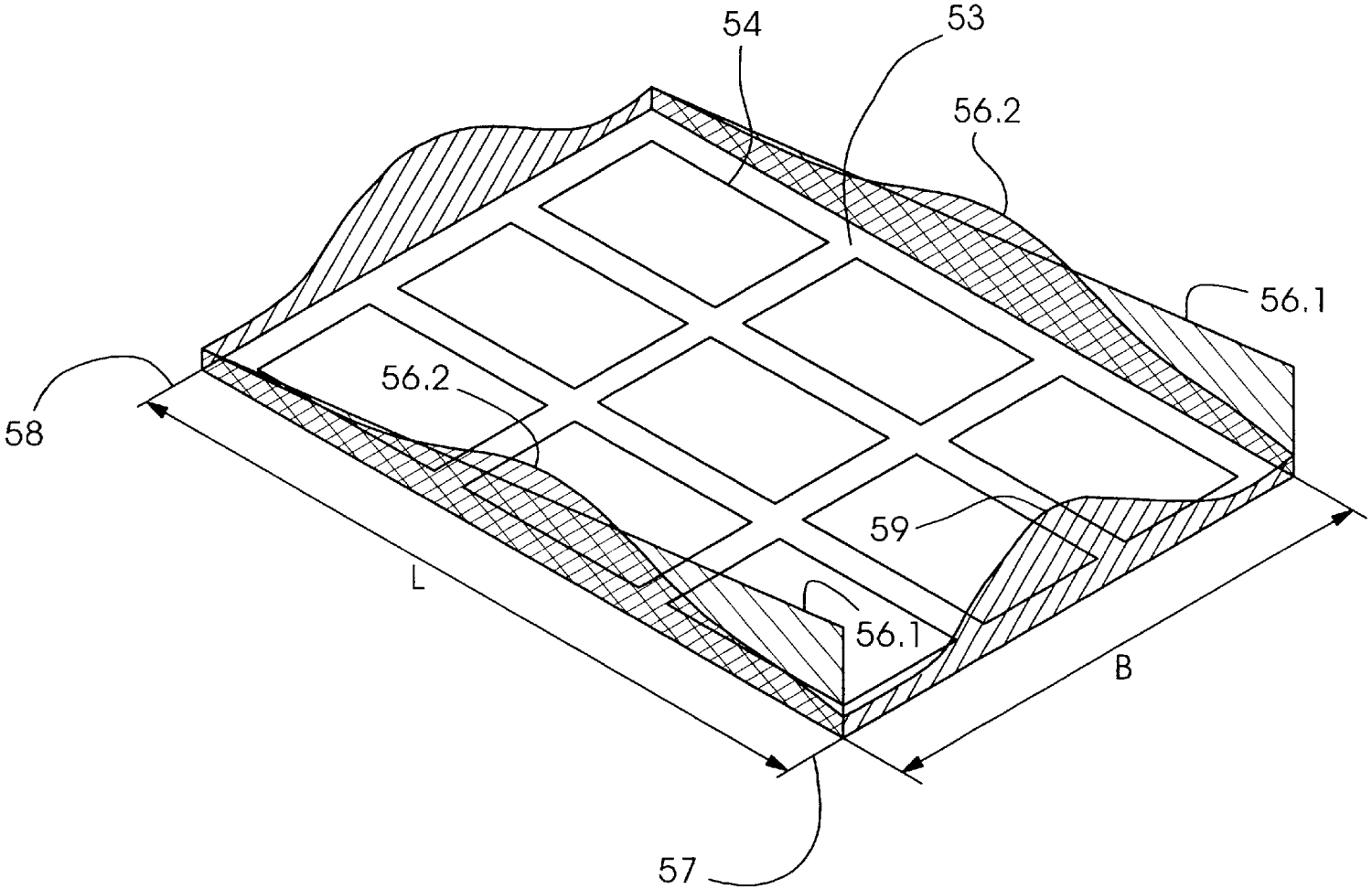
FIG. 3 is a perspective view of a sheet printed in the printing machine accompanied by a diagrammatic representation of an inking profile distortion and ink fading before and after an adjustment of a distribution starting time.

FIG. 3 illustrates a printing-material sheet 53 whereon several duplicates 54 are printed by the printing form 50. Due to the provision of a cylinder gap 55 (note FIG. 2) formed in the printing form cylinder 6, before the adjustment of the starting time of the distributor roller 9, severe ink fading 56.1 of the optical density in the printed image is noted over the format length L, with a maximum at the printing start 57, which is shown exaggerated and in symbolic form. Due to the adjustment of the starting time at the drive transmission G2 (note FIG. 2), the maximum is displaced in a direction towards the printing end 58 as far as the center of the format length L, and the so-called inking peak is displaced, respectively, as is shown, as a result of the displacement by the ink fading 56.2 that is more favorable in printing technology terms.

The displacement of the starting time is compensated for, as shown in FIG. 2, by the control device 49 which, for this purpose, follows-up or tracks the ink metering device 13, in hereinafter further described ways for adjusting the starting time, so that a variation in ink density 59 extending over the format width B is actually not distorted at all.

Figure 4:
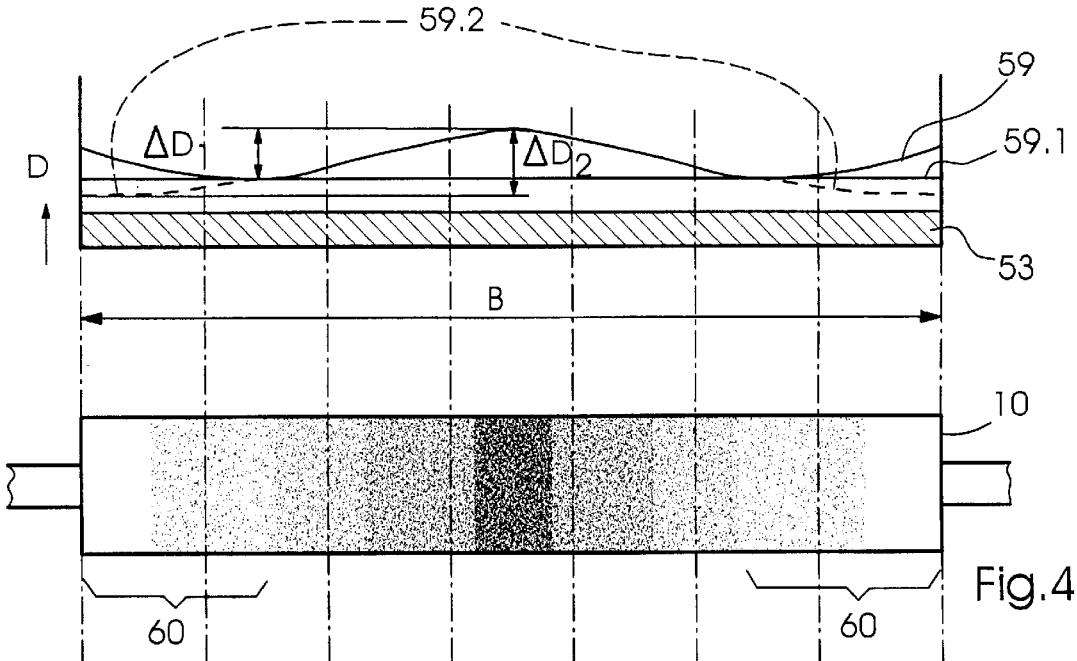
FIG. 4 is a plot diagram of a symmetrical inking profile distortion in the case of an odd-numbered vibrator cycle and an even-numbered distributor cycle of the inking unit.

FIG. 4 illustrates the ink density variation 59 on the printing material sheet 53, as viewed in the printing direction. The ink density variation 59 is not identical with the inking profile 52 but is superimposed on the inking profile 52. In the interest of better comprehension, the inking profile 52 has been disregarded in the method of representation selected for FIGS. 3 to 5, i.e., it has been assumed that all of the metering elements 21 to 27 would be set to an equally large metering gap 41 to 47, respectively.

An ideal varying ink density course 59.1, constant over the format width B, cannot be attained under practical conditions. The varying ink density course 59 that is realizable and that is optimal from a printing technology standpoint is axially symmetrical relative to the center of the format width B and has a comparatively small fluctuation range $\Delta D_1$ of the optical density D and of the film thickness of the printing ink.

With regard to the distortion of the optimum varying ink density course 59 so as to form a disrupted varying ink density course 59.2 and 59.3, respectively, because of an adjustment in the starting time, a distinction can be drawn between two cases with effects of differing severity, namely, on the one hand, the less severely disturbed varying ink density course 59.2 (note FIG. 4) in the case of an odd-numbered vibrator cycle in combination with an even-numbered distributor cycle and, on the other hand, the more severely disrupted varying ink density course 59.3 (note FIG. 5) in the event of an even-numbered vibrator cycle in combination with an even-numbered distributor cycle.

By distributor cycle there is understood to mean the number of revolutions of the printing form cylinder 6 during one complete axial oscillation of the distributor roller 9. In the case wherein the printing form cylinder 6 has a single printing form 50 mounted thereon, the choice of an even-numbered distributor cycle, for example having the value two, in which case one also speaks of a half-turn distributor cycle, is advantageous.

By the vibrator cycle there is understood to mean the number of revolutions of the printing form cylinder 6 during a complete oscillation, the so-called cycle, of the vibrator roller 8 from the ink-fountain roller 12 to the distributor roller 9 and back again. In some printing machines, the choice of an odd-numbered vibrator cycle, for example with the value three, in which case one also speaks of a ⅓-turn vibrator cycle, and in the case of other printing machines, the choice of an even-numbered vibrator cycle, for example with the value two, i.e., a half-turn vibrator cycle, is advantageous. Within each complete vibrator cycle, the vibrator roller 8 is in rolling contact with the ink-fountain roller 12 approximately during one third of the vibrator oscillation period, the so-called ductor contact time, moves from the ink-fountain roller 12 towards the distributor roller 9 approximately during one sixth of the vibrator oscillation period, rolls on the distributor roller 9 approximately during a further third of the vibrator oscillation period, the so-called distributor contact time, and moves back towards the ink-fountain roller 12 approximately during one sixth of the vibrator oscillation period.

In the case of the odd-numbered vibrator cycle in combination with an even-numbered distributor cycle (note FIG. 4), the distributor roller 9, as seen in FIG. 2, moves in a direction towards the right-hand dead point position 9.3 of the distributor roller 9 during the rolling contact between the vibrator roller 8 and the distributor roller 9 and, after a vibrator oscillation, moves in the direction towards the left-hand dead point position 9.2 during the following rolling contact. After the adjustment of the starting time, the alternating axial direction of movement of the distributor roller 9 causes ink transfer disturbances 60 (note FIG. 4) and an inking profile distortion resulting therefrom. The ink deficiency disturbances 60 occur not only at both ends of the inking-unit roller 10, when the distributor roller 9, at the instant at which the vibrator roller 6 encounters the distributor roller 9, is located just in a position which is off-center and offset towards the left-hand dead point position 9.2 or right-hand dead point position 9.3 thereof, but also when the distributor roller 9 is located just in the central axial position 9.1 as it encounters the vibrator roller 8.

FIG. 4 shows that after the adjustment of the starting time, the varying ink density course 59.2 is disturbed and has an enlarged fluctuation range $\Delta D_2$, which manifests itself as a drop in the ink density in the edge regions of the printing format. The cause of this effect is that too little ink is transferred from the vibrator roller 8 via the distributor roller 9 to the inking-unit roller 10, which is held against movement, i.e., stationary, in the axial direction, in the circumferential regions close to the edges of the rollers 8 and 10. From time to time, the distributor roller 9 for ink transfer is missing from the interspace between the aforementioned circumferential regions close to the edge of the vibrator roller 8 and the inking-unit roller 10.

If it is assumed, for example, that the distributor roller 9 is located in the right-hand dead point position 9.3 thereof while the vibrator roller 8 is rolling on the distributor roller 9, the ink transfer from the vibrator roller 8 to the distributor roller 9 is interrupted from time to time within the inking zone 31. During the subsequent rolling contact between the vibrator roller 8 and the distributor roller 9, in the case of the odd-numbered vibrator cycle and the even-numbered distributor cycle, the distributor roller 9 would be located in the left-hand dead point position 9.2 thereof, and thus the ink transfer would be interrupted from time to time in the inking zone 37.

In the foregoing explanations, in order to simplify the comprehension of the problems, the fact that, during the overall duration of the rolling contact by the distributor roller 9 with the vibrator roller 8, the distributor roller 9 does not remain in the dead point positions 9.2 and 9.3 but rather moves towards the respective dead point position 9.2 or 9.3 or away from the respective positions is disregarded. The ink transfer is thus disturbed to an increasing extent in the direction towards the side edge of the rollers, within the circumferential region close to the edge of the rollers. During the distributor contact time, in a circumferential area which is also at the side edge of the vibrator roller 8, no ink transfer can take place, and in a circumferential area adjacent to this circumferential area in the axial direction towards the center of the roller, the ink transfer which can take place is shortened as a result of the oscillatory movement. For example, in the case of a specific distributor reciprocating amplitude, the ink deficiency 60 on the inking-unit roller 10 in the left-hand half of the inking zone 31 can be greater than in the right-hand half thereof, and in the right-hand half of the inking zone 37, it can be greater than in the left-hand half thereof. Due to the axial ink distribution, the ink deficiency 60 from the inking zone 31 has an effect upon or works into the right-hand half of the inking zone 32, and the ink deficiency from the inking zone 37 has an effect upon or works into the left-hand half of the inking zone 36, so that the result at the two circumferential edges of the inking-unit roller 10 is an ink layer thickness which decreases in the direction towards the roller ends thereof and, in the printed image, a reduction in the optical density D (indicated in FIG. 4 as a broken line) towards the side edges of the format.

In the foregoing explanations, a simplification has been made that the inking profile set on the ink metering device 13 is constant over the format width B. In fact, however, in the ink metering device 13, the inking profile 52 is not constant but is set in a manner suitable for the subject, as shown in FIG. 2. Strictly speaking, it must therefore be noted that, in the direction towards the ends of the inking-unit roller 10, the difference between the desired ink layer thickness according to the inking profile 52 and the actual ink layer thickness caused by the ink transfer disturbance increases.

In order to return the disturbed varying ink density course 59.2 to the optimum varying ink density course 59, the control device 49 drives the actuating motors S1, S2, S6 and S7 in a manner that, by adjusting the metering elements 21, 22, 26 and 27 into the respective positions 21.1, 22.1, 26.1 and 27.1 thereof, the metering gaps 41, 42, 46 and 47, respectively, are enlarged. The magnitude of the adjustment of each metering element 21, 22, 26 and 27 is produced, in the calculation by the control device 49, on the one hand, from the ink layer thickness preset in the corresponding ink zones 31, 32, 36 and 37, i.e., the inking profile 52 suitable for the subject and stored in the control device 49 and/or the preset metering gaps 41, 42, 46 and 47, respectively, as well as from the angle of adjustment of the starting time. The correction value may be composed of a fixed and a variable component. The metering elements 21 and 27 located farther in the direction towards the roller edge can be opened to a greater extent and, for example, by twice the amount, than the metering elements 22 and 26 located farther towards the center of the roller, as is shown.

If the pressman adjusts the starting time by operating the drive transmission G2 manually or by controlling the drive transmission G2 via the control device 49, the afore-described adjustment of the ink metering device 13 is performed virtually simultaneously in order to compensate for the adjustment of the starting time. It may also be possible, however, for the adjustment of the ink metering device 13 for compensation purposes to be driven by the control device 49 only after the adjustment of the starting time has been completed.

Figure 5:
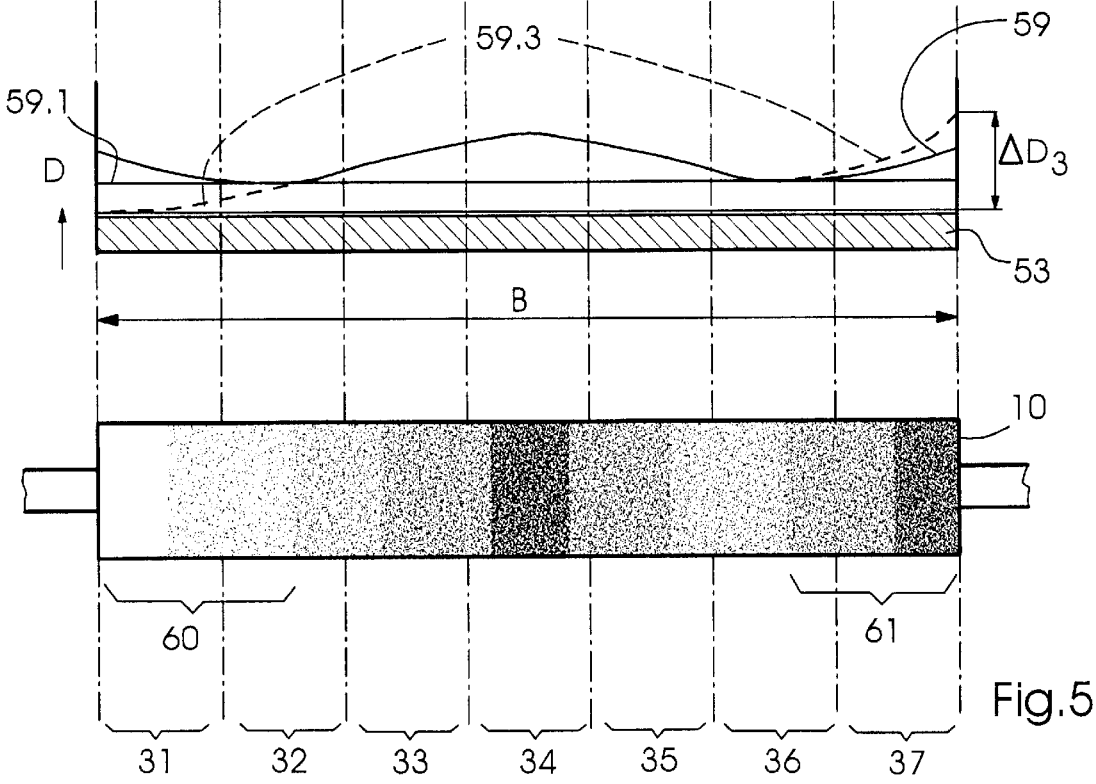
FIG. 5 is a plot diagram of an asymmetric inking profile distortion in the case of an even-numbered vibrator cycle and an even-numbered distributor cycle of the inking unit.

FIG. 5 illustrates the effects of a half-turn vibrator cycle in combination with a half-turn distributor cycle. In the case of the even-numbered vibrator cycle in combination with the even-numbered distributor cycle, the distributor roller 9 moves in the direction towards the right-hand dead point position 9.3 of the distributor roller 9 during rolling contact between the vibrator cycle 8 and the distributor roller 9 and, following a vibrator oscillation, likewise moves in the direction of the right-hand dead point position 9.3 of the distributor roller 9 during the subsequent rolling contact. In other words, the axial direction of movement of the distributor roller 9 is the same each time the vibrator roller 8 encounters the distributor roller 9. Consequently, in the region of one format edge, for example the left-hand edge in FIG. 5, there result approximately the same effects as have already been described in connection with an odd-numbered vibrator cycle and an even-numbered distributor cycle as shown in FIG. 4. As FIG. 5 shows, in the region of the opposite format side edge, i.e., the right-hand edge in FIG. 5, the result of the adjustment of the starting time is the opposite effect, so that the fluctuation range $\Delta D_3$ is, unfavorably, even greater than the fluctuation range $\Delta D_2$. The cause of the decrease in the optical density D in the direction towards the left-hand format edge, and the compensation for the ink deficiency 60 at the left-hand edge of the inking-unit roller 10, note FIG. 5), respectively, do not have to be discussed again hereinafter because, in this respect, that which has already been described with regard to FIG. 4 applies in the same manner with regard to FIG. 5.

The cause of the increase in the optical density D in the direction towards the right-hand format edge is the changed axial position of the distributor roller 9, following the adjustment of the starting time, when the vibrator roller 8 encounters the distributor roller 9. This results in an excess (ink excess 61) of ink transferred from the vibrator roller 8 via the distributor roller 9 onto the inking-unit roller 10, which is stationary in the axial direction, in the circumferential regions thereof close to the right-hand roller edge. The excess of ink is located on those circumferential regions of the distributor roller 9 which, when the latter encounters the vibrator roller 8, project to the right-hand side beyond the vibrator roller 8. When the distributor roller 9, after it has encountered the vibrator roller 8, moves in the direction of the left-hand dead point position 9.2 thereof during the distributor contact time, the ink on the projecting circumferential region is transferred to the circumferential regions close to the roller edge and, for example, within the inking zone 37, in addition to the quantity of ink corresponding to the inking profile 52. In this case, the continuously increasing ink excess 61 in the right-hand half of the inking zone 37 can be greater than that in the left-hand half of the inking zone 37 and the ink excess 61 can be transferred as far as the inking zone 36 because of the axial ink distribution. The discharge of ink from the circumferential regions of the distributor roller 9 which project beyond the vibrator roller 8 in the axial direction when they encounter one another, to circumferential regions close to the edge of the inking-unit roller 10, takes place in the same way during each vibrator cycle, so that because of the accumulation of ink close to the edge, the result is the asymmetrical, disturbed ink density variation 59.3.

In connection with the just presented explanation, a simplification has again been made, it being assumed that the distributor roller 9 is located in the right-hand dead point position 9.3 thereof when the vibrator roller 8 encounters the distributor roller 9. The axial position of the distributor roller 9 when it encounters the vibrator roller 8 can be quite different, depending upon the adjustment of the starting time. For example, the distributor roller 9 can move farther, over a small distance, in the direction towards the right-hand dead point position 9.3 thereof, before the distributor roller 9, after a change of direction, moves over a greater distance in the direction towards the left-hand dead point position 9.2 thereof. However, in this case, the axial direction of movement of the distributor roller 9 is also the same each time the vibrator roller 8 encounters the distributor roller 9, as a result of which the left-hand end ink deficiency 60 and the right-hand end ink excess 61 on the inking-unit roller 10 are produced.

In order to return the disturbed varying ink density course 59.3 to the optimum varying ink density course 59, the control device 49 drives the actuating motors S1, S2, S6 and S7 so that, by adjusting the metering elements 21, 22, 26 and 27, respectively, into the respective positions 21.1, 22.1, 26.2 and 27.2 thereof, the metering gaps 41 and 42 are enlarged and the metering gaps 46 and 47 are reduced. The magnitude of the adjustment of each metering element 21, 22, 26 and 27 is provided, in the course of the calculation in the control device 49, on the one hand by the ink layer thickness set in the corresponding inking zones 31, 32, 36 and 37, i.e., in the preset metering gap 41, 42, 46 and 47, respectively, corresponding to the inking profile 52 suitable for the subject, and on the other hand, respectively, by a correction value stored in the control device 49, which can be determined empirically.

For example, the metering element 27 can be adjusted towards the ink-fountain roller 12 to a greater extent than the metering element 26 and, for example, twice the amount of adjustment thereof, as shown in FIG. 2. In the case of printing machines wherein there are metering elements disposed outside the format width B, i.e., the ink-fountain width is greater than the printing width, a metering element adjoining the metering elements 27 outside the format width B can be closed completely, so that it no longer lets any ink out of the ink fountain 11.

Even in the case of the compensation for the starting time, described with reference to FIG. 5, as a result of the manual actuation of the drive transmission G2 by the pressman or as a result of controlling this drive transmission G2 via the control device 49, the pressman can rely upon the fact that the control device 49 will automatically track the ink metering device 13 to the adjusted starting time in the manner described, preferably synchronously with the adjustment of the drive transmission G2 and possibly lagging behind this adjustment.

I claim:

1. A method of controlling the supply of ink in a printing machine wherein the ink is differently guided zonally on an ink-fountain roller transversely to the printing direction, and is transferred by a vibrator roller to a distributor roller, which comprises metering the ink zonally in dependence on a stroke movement of the distributor roller for counteracting ink transfer disturbances caused by the stroke movement of the distributor roller, so as to minimize the disturbances automatically to at least an effective extent.

2. The method according to claim 1, wherein the ink transfer disturbances are at least one of ink deficiency and ink excess disturbances resulting from a change in a periodically repeating edge offset of the distributor roller with respect to the vibrator roller as ink is transferred from the vibrator roller to the distributor roller, the disturbances being located in the vicinity of the edge offset, and which includes compensatingly adjusting the supply of ink in at least one of the inking zones affected by the ink transfer disturbances so as to effectively minimize or eliminate the ink transfer disturbances.

3. The method according to claim 1, which includes adjusting an inflow of ink into at least one inking zone close to a roller edge so as to compensate for the ink transfer disturbances.

4. A method of controlling the supply of ink in a printing machine, which comprises:

metering zonally differentiated ink on an ink-fountain roller transversely to a printing direction;

transferring the ink by a vibrator roller to a distributor roller; and performing the step of zonally metering the ink in dependence on a stroke movement of the distributor roller to counteract ink transfer disturbances caused by the stroke movement of the distributor roller.

5. The method according to claim 4, wherein the ink transfer disturbances are at least one of ink deficiency and ink excess disturbances resulting from a change in a periodically repeating edge offset of the distributor roller with respect to the vibrator roller as ink is transferred from the vibrator roller to the distributor roller.

6. The method according to claim 4, wherein the ink transfer disturbances are located in a vicinity of the edge offset, and the method further comprises adjusting the metering of zonally differentiated ink in at least the vicinity of the edge offset for counteracting the ink transfer disturbances.

7. The method according to claim 4, which further comprises adjusting the metering of zonally differentiated ink for at least one inking zone close to a roller edge for compensating the ink transfer disturbances.

* * * * *